US012291948B2

(12) United States Patent
Maryono et al.

(10) Patent No.: US 12,291,948 B2
(45) Date of Patent: May 6, 2025

(54) REVIVING A HYDROCARBON WELL UTILIZING GAS INJECTION PORTS

(71) Applicant: Saudi Arabian Oil Company, Dhahran (SA)

(72) Inventors: Iyon Maryono, Udhailiyah (SA); Fahmi Aulia, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/351,869

(22) Filed: Jul. 13, 2023

(65) Prior Publication Data

US 2025/0020047 A1 Jan. 16, 2025

(51) Int. Cl.
*E21B 43/12* (2006.01)

(52) U.S. Cl.
CPC ..... *E21B 43/123* (2013.01)

(58) Field of Classification Search
CPC ..... E21B 43/122; E21B 43/123
See application file for complete search history.

(56) References Cited

U.S. PATENT DOCUMENTS

| | | | | |
|---|---|---|---|---|
| 5,458,200 | A * | 10/1995 | Lagerlef | E21B 43/123 166/372 |
| 2006/0137881 | A1* | 6/2006 | Schmidt | E21B 43/123 166/372 |
| 2014/0039793 | A1* | 2/2014 | Querales | E21B 43/122 702/6 |
| 2019/0292888 | A1* | 9/2019 | Archa | E21B 43/122 |
| 2020/0182027 | A1* | 6/2020 | Romer | E21B 43/123 |
| 2021/0348604 | A1* | 11/2021 | Nelle | F04B 49/22 |

FOREIGN PATENT DOCUMENTS

| | | |
|---|---|---|
| GB | 2429722 | 3/2007 |
| WO | WO2021201887 | 10/2021 |

* cited by examiner

*Primary Examiner* — Giovanna Wright
(74) *Attorney, Agent, or Firm* — Fish & Richardson P.C.

(57) ABSTRACT

A well system includes a production string that extends in a wellbore from a terranean surface toward a reservoir formation; and a portable gas injection system configured to supply the fluid to the annulus to reduce a hydrostatic pressure of a wellbore fluid enclosed within at least one of the annulus or the production tubing downhole tool coupled within the production string. The downhole tool includes a mandrel that includes a top connection connected to the production string and a bottom connection connected to the production string to fluidly couple the mandrel to the production string, at least one gas injection port that fluidly couples the mandrel to an annulus of the wellbore, and a valve positioned to control a flow of a fluid from the annulus into the mandrel through the gas injection port.

21 Claims, 4 Drawing Sheets

REVIVING A HYDROCARBON WELL UTILIZING GAS INJECTION PORTS

TECHNICAL FIELD

The present disclosure relates to systems, apparatus, and methods for reviving or unloading a hydrocarbon well, such as a hydrocarbon well which is no longer capable of sustained flow of a hydrocarbon fluid from a reservoir to a terranean surface.

BACKGROUND

During a hydrocarbon (for example, oil) production phase, one of the challenges that subsequently leads to production loss is when the hydrocarbon production well is no longer capable to sustain a flow of hydrocarbons to the surface, thereby becoming a dead well. Beside declining well performance, other causes of dead wells can be heavy fluid accumulated inside the wellbore, which causes the well to cease or reduce a flow of hydrocarbons. This occurs mostly due to post workover operations, prolonged shut-in, and any other well intervention jobs involving heavy fluid that is pumped into the wellbore. Several artificial lifting methods are established that utilize downhole pumps, sucker rods, and gas lift systems to unload and revive the well. However, many wells that are not equipped with artificial lift systems and have no availability for gas injection supply facilities in the field.

SUMMARY

In an example implementation, a well system includes a production string that extends in a wellbore from a terranean surface toward a reservoir formation; and a portable gas injection system configured to supply the fluid to the annulus to reduce a hydrostatic pressure of a wellbore fluid enclosed within at least one of the annulus or the production tubing downhole tool coupled within the production string. The downhole tool includes a mandrel that includes a top connection connected to the production string and a bottom connection connected to the production string to fluidly couple the mandrel to the production string, at least one gas injection port that fluidly couples the mandrel to an annulus of the wellbore, and a valve positioned to control a flow of a fluid from the annulus into the mandrel through the gas injection port.

In an aspect combinable with the example implementation, the fluid includes nitrogen.

In another aspect combinable with any of the previous aspects, the portable gas injection system is configured to supply the nitrogen at 1500 psi.

In another aspect combinable with any of the previous aspects, the top and bottom connections include threaded connections.

In another aspect combinable with any of the previous aspects, a length of the mandrel is less than 30 feet.

In another aspect combinable with any of the previous aspects, the downhole tool is a first downhole tool, and the system further includes a second downhole tool coupled within the production string.

In another aspect combinable with any of the previous aspects, the second downhole tool includes a mandrel that includes a top connection connected to the production string and a bottom connection connected to the production string to fluidly couple the mandrel to the production string; at least one gas injection port that fluidly couples the mandrel to the annulus of the wellbore; and a valve positioned to control a flow of the fluid from the annulus into the mandrel through the gas injection port of the second downhole tool.

In another aspect combinable with any of the previous aspects, the gas injection port of the second downhole tool is between 1500 and 2000 feet from the gas injection port of the first downhole tool.

Another aspect combinable with any of the previous aspects further includes a packer positioned in the annulus downhole of the first and second downhole tools.

In another aspect combinable with any of the previous aspects, the fluid has at least one of a density or a viscosity less than the wellbore fluid.

In another example implementation, a method for unloading a wellbore includes installing a portable gas injection system adjacent a production workstring that extends in a wellbore from a terranean surface to a reservoir formation. The production workstring includes a downhole tool coupled within the production workstring. The downhole tool includes a mandrel that includes a top connection connected to the production string and a bottom connection connected to the production workstring to fluidly couple the mandrel to the production string, at least one gas injection port that fluidly couples the mandrel to an annulus of the wellbore, and a valve positioned to control a flow of a fluid from the annulus into the mandrel through the gas injection port. The method includes operating the portable gas injection system to supply the fluid to the annulus to reduce a hydrostatic pressure of a wellbore fluid enclosed within at least one of the annulus or the production workstring.

In an aspect combinable with the example implementation, the fluid includes nitrogen.

In another aspect combinable with any of the previous aspects, operating the portable gas injection system to supply the fluid to the annulus includes operating the portable gas injection system to supply the nitrogen to the annulus at 1500 psi.

In another aspect combinable with any of the previous aspects, the top and bottom connections include threaded connections.

In another aspect combinable with any of the previous aspects, a length of the mandrel is less than 30 feet.

In another aspect combinable with any of the previous aspects, the downhole tool is a first downhole tool, and the production workstring further includes a second downhole tool.

In another aspect combinable with any of the previous aspects, the second downhole tool includes a mandrel that includes a top connection connected to the production workstring and a bottom connection connected to the production workstring to fluidly couple the mandrel to the production workstring; at least one gas injection port that fluidly couples the mandrel to the annulus of the wellbore; and a valve positioned to control a flow of the fluid from the annulus into the mandrel through the gas injection port of the second downhole tool.

Another aspect combinable with any of the previous aspects further includes operating the portable gas injection system to supply the fluid to the annulus and through the gas injection ports of the first and second downhole tools to reduce the hydrostatic pressure of the wellbore fluid enclosed within at least one of the annulus or the production workstring.

In another aspect combinable with any of the previous aspects, the gas injection port of the second downhole tool is between 1500 and 2000 feet from the gas injection port of the first downhole tool.

In another aspect combinable with any of the previous aspects, a packer is positioned in the annulus downhole of the first and second downhole tools.

In another aspect combinable with any of the previous aspects, the fluid has at least one of a density or a viscosity less than the wellbore fluid.

Another aspect combinable with any of the previous aspects further includes logging the wellbore during operating the portable gas injection system to supply the fluid to the annulus to reduce the hydrostatic pressure of a wellbore fluid enclosed within at least one of the annulus or the production workstring.

In another aspect combinable with any of the previous aspects, logging the wellbore includes moving a logging tool through the production workstring during operating the portable gas injection system.

Implementations according to the present disclosure may include one or more of the following features. For example, implementations of systems, apparatus, and methods for reviving or unloading a hydrocarbon well can eliminate a need for well intervention by running a coil tubing unit and provides high productive time, low personnel and equipment involved, and low well control risk. Implementations according to the present disclosure can also provide for an acquisition of essential reservoir well data and information for future well production optimization strategy while avoiding early workover program. Implementations according to the present disclosure can also facilitate production logging jobs or any other well intervention activities (particularly for dead wells) simultaneously during gas lifting operations. Implementations according to the present disclosure can also immediately revive dead wells without the need of complex equipment mobilization to the wellsite, thus improving productive time and operating cost efficiency.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

The present disclosure describes apparatus, systems, and methods for reviving or unloading a hydrocarbon well, such as a dead well in which little to no flow of hydrocarbon (or other) fluid occurs to a terranean surface. In some aspects, example implementations according to the present disclosure include a downhole tool configured to coupled within a tubular workstring, such as a production tubing. In some aspects, the downhole tool can include one or more gas injection ports through which a gaseous or mixed phase fluid, such as nitrogen or other inert gas, can be supplied from the surface to reduce a hydrostatic column of fluid in the production tubing. By reducing the hydrostatic column of fluid, a flow of hydrocarbon fluids can be established to revive or unload the well. Implementations according to the present disclosure can also include multiple downhole tools installed in a single production string, each of which includes one or more gas injection ports (and, optionally, gas injection valves). Further, example implementations according to the present disclosure exclude artificial lift apparatus or systems, such as downhole pumps. Implementations according to the present disclosure can also provide for the gaseous or mixed phase fluid from a stand alone source of the fluid, rather than a permanent, gas injection supply facility.

Figure 1:
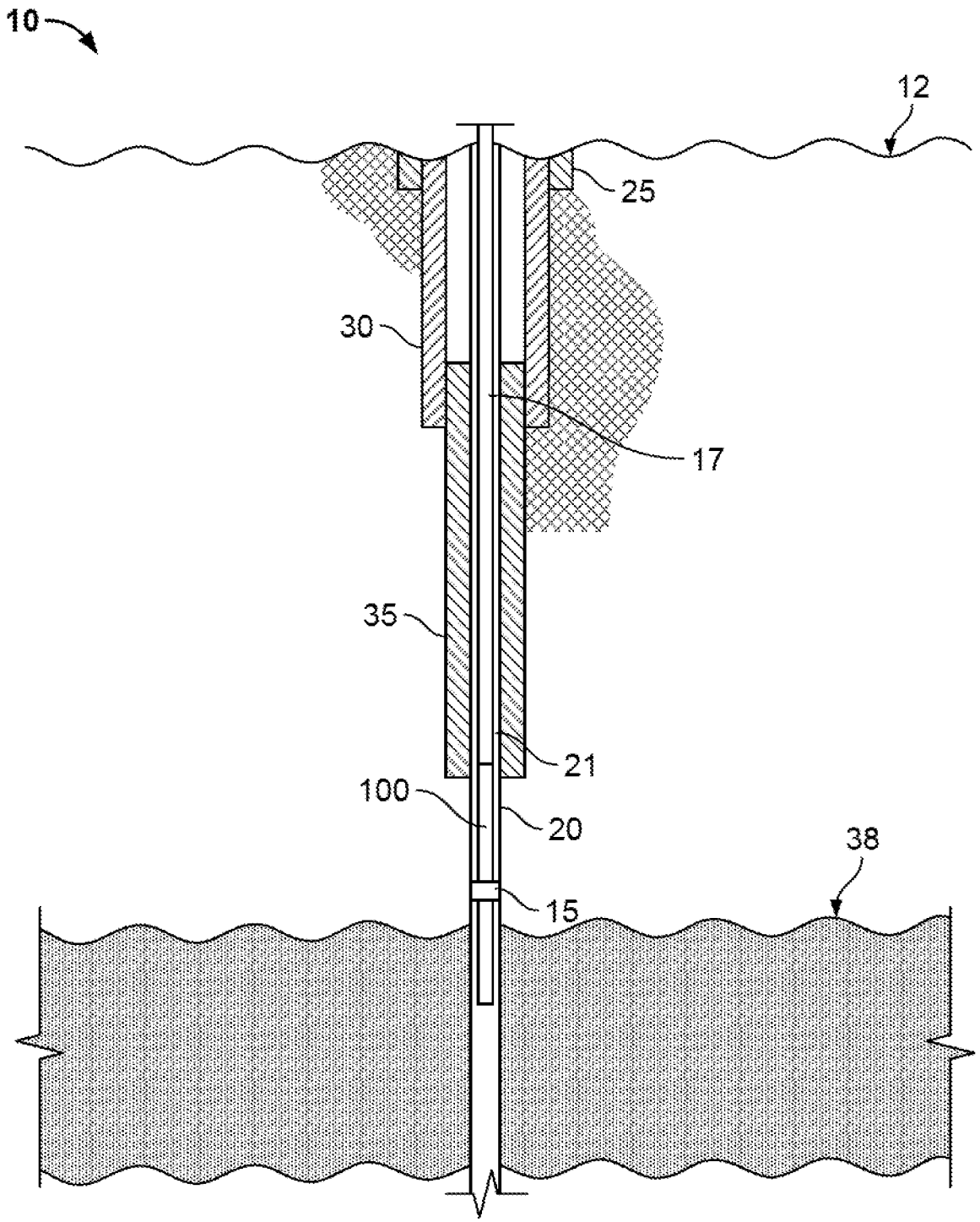
FIG. 1 is a schematic drawing of a wellbore system that includes a downhole tool for unloading or reviving a hydrocarbon well according to the present disclosure.

FIG. 1 illustrates an example well system 10, which includes downhole tool 100 coupled within (made up in) a production string 17. The downhole tool 100 (or multiple downhole tools 100) can be made up in the production string 17 in order to revive or unload a wellbore 20 formed from a terranean surface 12 into a reservoir formation 38. In some aspects, reservoir formation 38 can represent multiple formations. The wellbore 20 that is formed (for example, drilled) from the terranean surface 12 (whether on land or under a body of water) through multiple geologic formations, including reservoir formation 38. The wellbore 20, although shown as vertical, can be directional, horizontal, slanted, or lateral or a combination thereof. The downhole tool 100 can be moved (run into or out of the wellbore 20) on the production string 17 such that the downhole tool 100 can be placed at a particular depth in the wellbore 20. In some aspects, as shown, one or more casings 25, 30 and/or 35 can be installed (for example, cemented into) the wellbore 20. In some aspects, all or a part of the wellbore 20 can be open hole.

As shown in this example, a wellbore seal 15, such as a packer 15, is installed in an annulus 21 of the wellbore 20 between the production string 17 and the casing 35 (or open hole of the formation). Although the packer 15 is shown installed in an open hole section, packer 15 (or multiple packers 15) can be installed in the annulus 21 at the production casing 35.

Figure 2A:
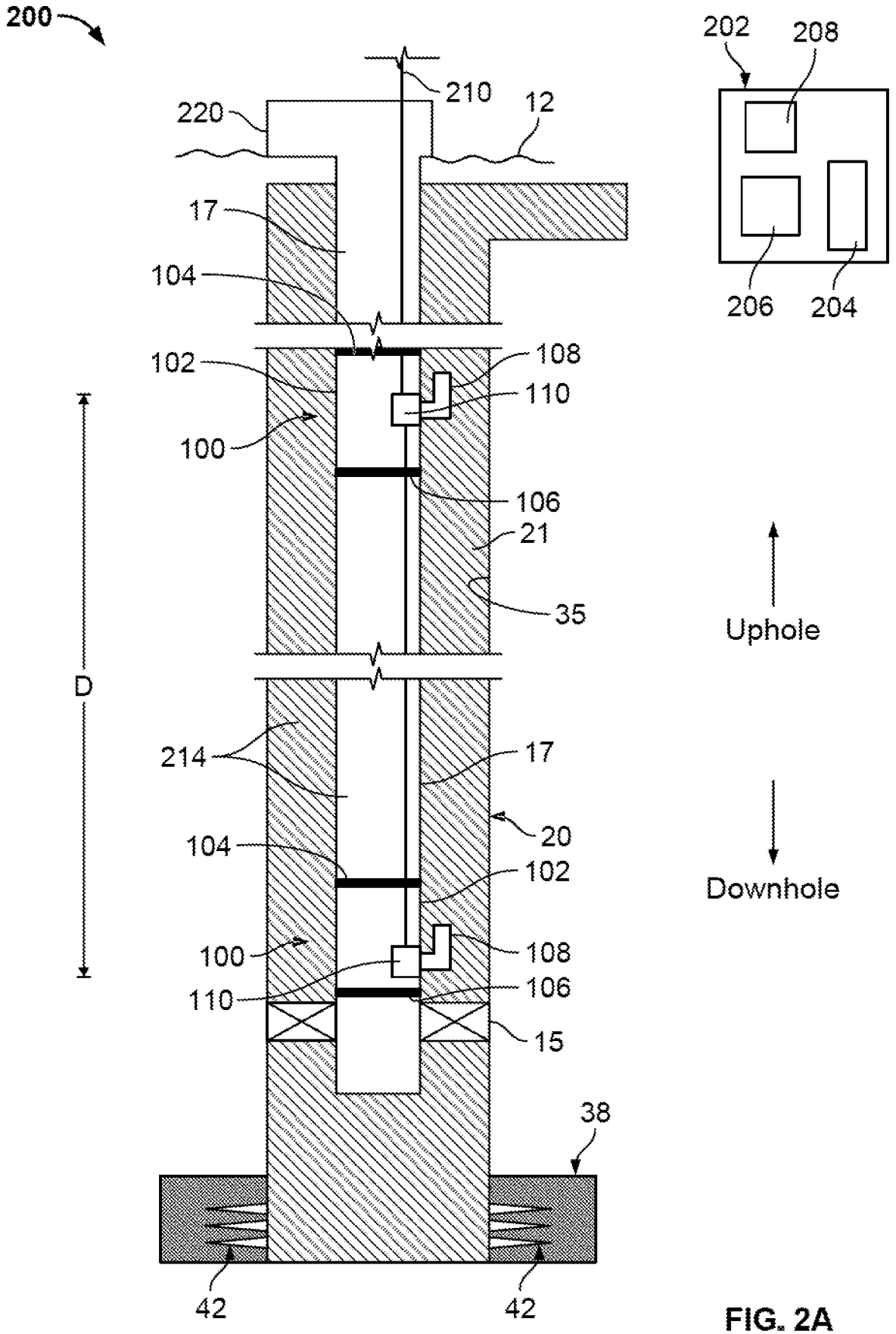
FIGS. 2A and 2B illustrate schematic views of an example implementation of a wellbore system with one or more downhole tools for unloading or reviving a hydrocarbon well according to the present disclosure.
Figure 2B:
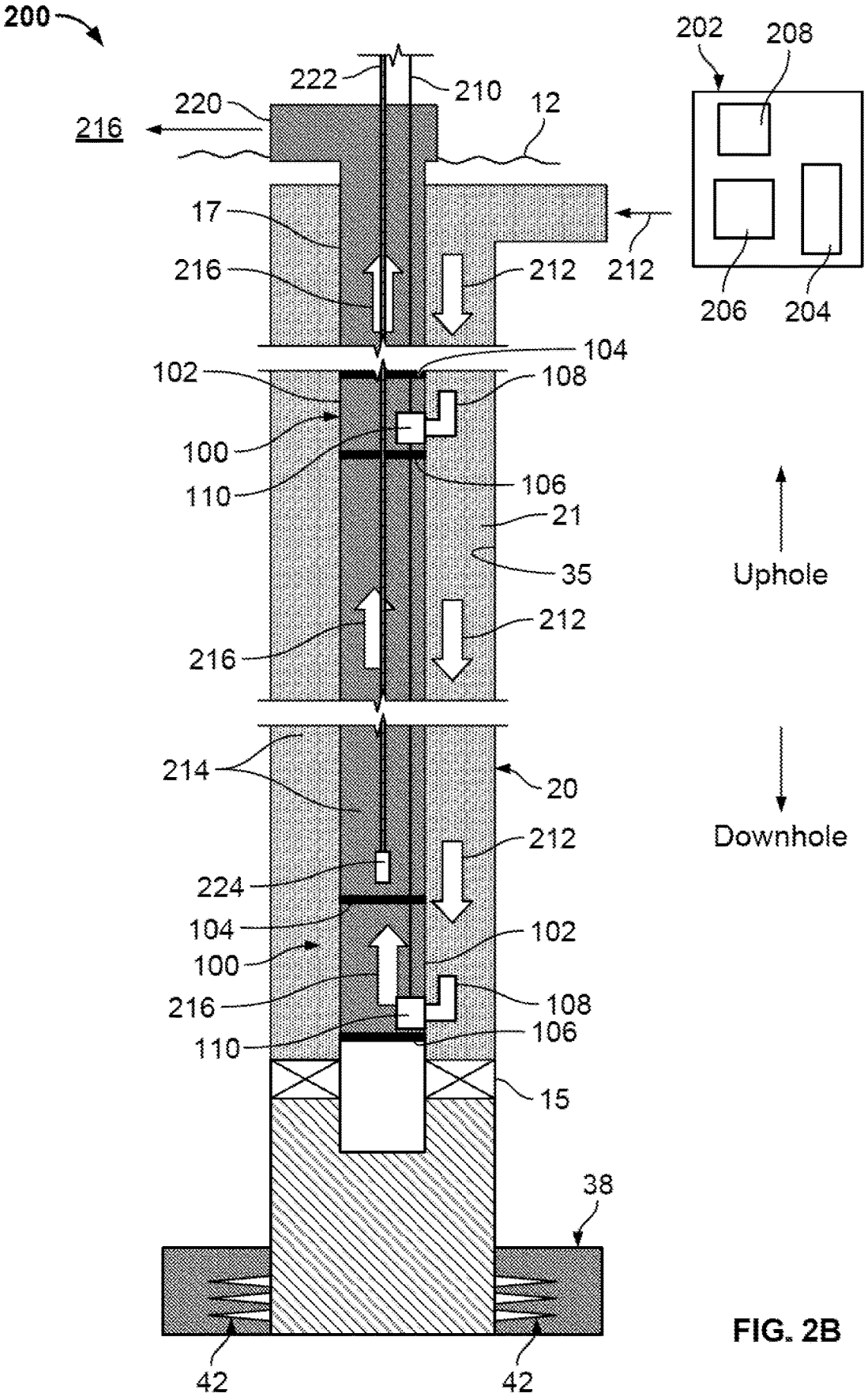

FIGS. 2A and 2B illustrate schematic views of an example implementation of the downhole tool 100 for unloading or reviving a hydrocarbon well according to the present disclosure. Indeed, these figures show a wellbore system 200 in which multiple (two in this example) downhole tools 100 are installed in the production string 17 between the terranean surface 12 and the reservoir formation 38 (which has been fractured for production with hydraulic fractures 42). In this example, the production string 17 extends down to the reservoir formation 38.

FIG. 2A shows this example wellbore system 200 in a state in which the wellbore 20 (including the production string 17) can be filled with heavy (for example, non-flowing or stagnant) hydrocarbon fluid 214 (or a mix of hydrocarbons and other fluids). In some aspects, the heavy hydrocarbon fluid 214 accumulated inside the wellbore 20 (and production string 17 in some cases) can cause the well to cease flow. This can occur due to, for example, post workover operation, prolonged shut-in, and any other well intervention jobs involving heavy fluid that is pumped into the wellbore 20. In some aspects, the heavy hydrocarbon fluid 214 accumulated inside the wellbore 20 can be mostly due to accumulated heavy fluid inside the wellbore post workover operations, with a high gradient fluid more than 0.5 psi/ft of the wellbore 20. The high gradient fluid or water hold-up also occurs when the well is shut-in for long period of time, such as during a plant shut down.

As shown in this example, each downhole tool 100 includes a mandrel 102 that comprises a tubular section with a top connection 104 and a bottom connection 106. Each of the top and bottom connections 104 and 106 can attach (for example, threadingly) to the production string 17 in order to make up the downhole tools 100 into the production string 17. Once made up, the mandrel 102 is in fluid communication with the production tubing 17 (between the reservoir formation 38 and the terranean surface 12). In some aspects, the mandrel 102 can be the same or similar length to standard production tubing joints (in other words, threaded pipe of about 30 feet or 9 meters) that make up the production string 17. Alternatively, the mandrel 102 can be shorter than standard production tubing joints.

As shown in FIG. 2A, each downhole tool 100 includes at least one (and, optionally, multiple) gas injection port 108. The gas injection port 108 fluidly couples the annulus 21 of the wellbore 20 (for example, uphole of the packer 15) to the production string 17 through the mandrel 102. In the illustrated example, a valve 110 (such as a gas injection valve) is installed, such as within the mandrel 102 at the gas injection port 108. The valve 110 can be operated, such as by a control line or signal 210 from the terranean surface 12, in order to control a flow of a fluid through the gas injection port 108 and, more generally, a flow of a fluid introduced into the annulus 21 and through the mandrel 102 of the downhole tool 100.

Although shown installed within the mandrel 102 at the gas injection port 108, the valve 110 can be installed at other locations, such as within the gas injection port 108 (itself), at or near the top connection 104 of the mandrel 102, or even within the production string 17.

In a specific example implementation, the illustrated downhole tools 100 each include one or more gas injection ports 108 and valves 110. In this example, the downhole tools 100 are installed within the production string 17 such that a distance, D, between the gas injection ports 108 is between about 1500 and 2000 feet; however, the distance, D, can be any desirable distance as needed. Each gas injection port 108 is a 4.5 inch port, and the production string 17 is a 4.5 inch string. The packer 15 is a 7 inch packer. The two valves 110 can be, in this example, different sizes. For example, the valve 110 in the uphole positioned downhole tool 100 can be a 12/64 inch valve, while the valve 110 in the downhole positioned downhole tool 100 can be a % inch valve.

In this example, wellbore system 200 includes a gas injection system 202 that is operable to supply an injection of gas (for example, nitrogen or other gas) into the annulus 21 (as explained more fully with reference to FIG. 2B). In this example, the gas injection system 202 includes a gas source 204, a pump 206 fluidly coupled to the gas source 204, and a power source 208 coupled to the pump 206. Generally, the gas injection system 202 can comprise a nitrogen portable unit that is moveable to adjust the location of the system 202 to the wellbore 20 to provide nitrogen gas injection in a well revival/unloading operation. Thus, in contrast to a nitrogen processing plant that is permanently constructed at a particular wellbore or wellbores and requires pipelines to fluidly connect to the wellbore(s), the system 202 can be moved from wellbore to wellbore independent of a permanent pipeline.

Turning to FIG. 2B, this figure shows the wellbore system 200 in an example revival or unloading operation of the wellbore 20. For example, as noted, in some cases, the wellbore 20 (and possibly production tubing 17) can be filled (all or partially) with a heavy fluid 214 (hydrocarbon or mixed). In order to revive or unload the wellbore 20 so that the heavy fluid 214 can flow through the production tubing 17 and to the terranean surface 12 (out of an outlet 220 of the production tubing 17), a fluid 212 can be provided from gas injection system 202 into the annulus 21. The fluid 212 can be, for example, nitrogen or other gas (or mixed phase fluid that has a lower density and/or viscosity than heavy fluid 214).

For example, gas injection system 202 can be operated so that the pump 206 (powered by power source 208) delivers the fluid 212 from the source 204 into the annulus 21. In some aspects, the fluid 212 is delivered at a pressure of about 1200 psi. As fluid 212 is circulated into the annulus 21, the gas injection ports 108 are open to receive the flow of the fluid 212. The valves 110 can be operated (for example, by control line or signal 210) to be in an open (fully or partially) to allow the fluid 212 into the mandrels 102 of the downhole tools 100 through the gas injection ports 108.

As the fluid 212 is circulated through the annulus 21 and the production tubing 17, it mixes with heavy fluid 214 to form a mixed fluid 216 that is lighter (for example, less dense and/or more viscous) than heavy fluid 214. As additional fluid 212 is provided through the annulus 21 and into the production tubing 17 (through the gas injection ports 108), the mixed fluid 216 begins to flow toward the outlet 220 of the production tubing 17. As flow through the outlet 220 is established, the wellbore 20 is unloaded of the heavy fluid 214 so that additional hydrocarbon fluid (for example, from the reservoir formation 38) can flow into the production tubing 17 (at a downhole end of the tubing string 17 downhole of the packer 15). As a result of this example operation, the hydrostatic column of the wellbore 20 can be lightened, which causes a drop of the bottom hole pressure and develops drawdown pressure to the reservoir pressure so that the wellbore 20 can flow naturally to the surface 12. The gas injection from the gas injection system 202 can be stopped once the wellbore 20 can sustain flow naturally within a period of time.

In some aspects, an operational sequence of the gas injection system 202 can be optimized through serial operation of the gas injection ports 108. For example, the gas injection ports 108 of the uphole positioned downhole tool 100 can be opened to allow flow (for example, by opening the associated valve 110 or at a certain injection pressure) of the fluid 212. The flow of fluid 212 will start removing and unloading the heavy fluid 214 in the production tubing 17 to the outlet by mixing and lightening the fluid 214. Next, the gas injection port 108 on the downhole positioned downhole tool 100 will open, for example, after closure of the gas injection port 108 on the uphole positioned downhole tool 100, by reducing and controlling the fluid injection pressure of the fluid 212.

In some aspects, during the flow of the fluid 212 through the annulus—and during flow of the mixed fluid 214 through the production tubing 17—the wellbore 20 can be logged by a logging tool 224 that can be moved through the production tubing 17 on a downhole conveyance 222 (such as a wireline or slickline). For example, the logging tool 224 can record or measure data such as temperature, pressure, composition of the mixed fluid 216, as well as other data.

Figure 3:
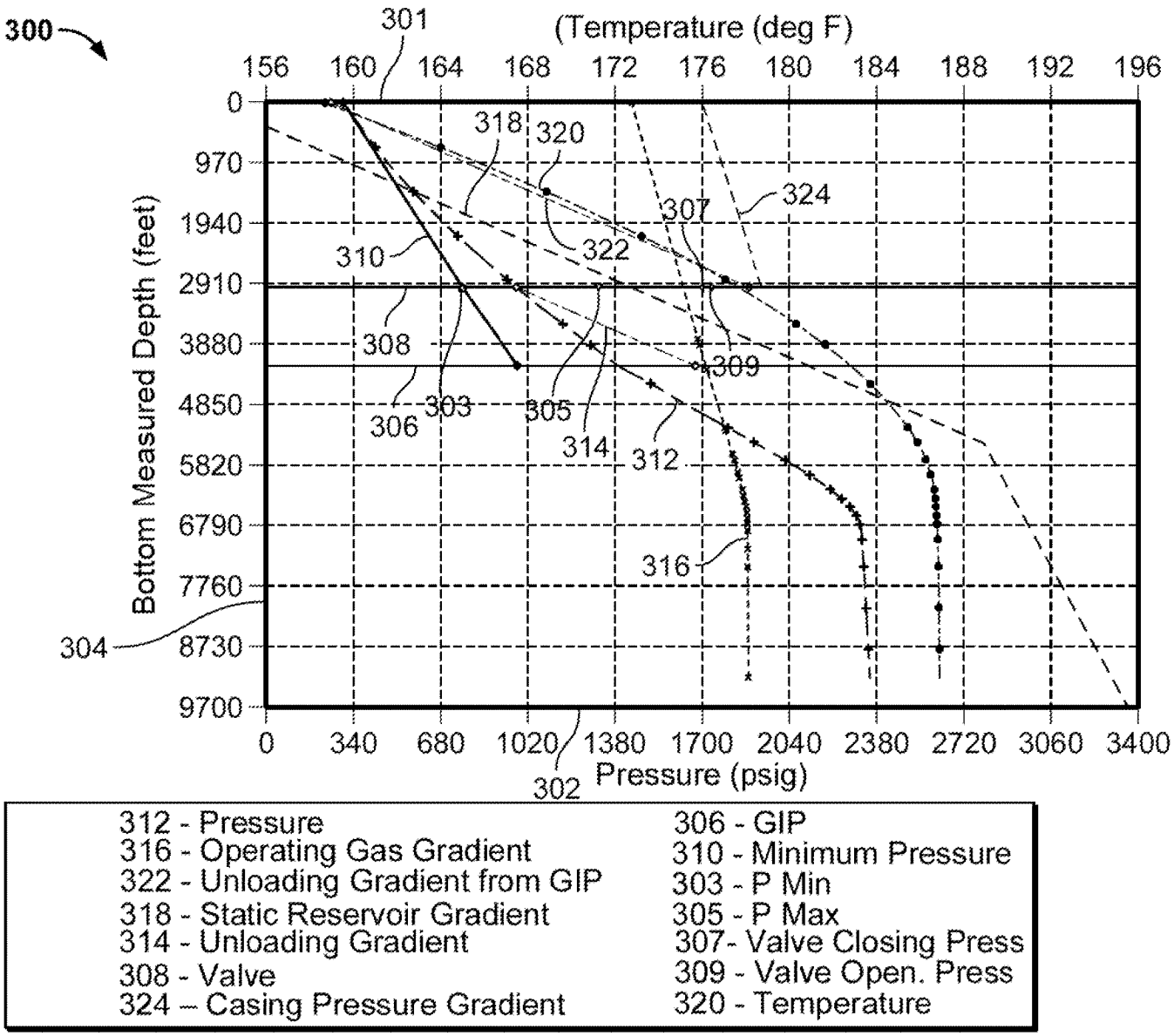
FIG. 3 illustrates a graphical representation of a simulation of an operation of an example implementation of a downhole tool for unloading or reviving a hydrocarbon well according to the present disclosure.

FIG. 3 illustrates a graphical representation of a simulation of an operation of an example implementation of a downhole tool for unloading or reviving a hydrocarbon well according to the present disclosure. For example, graph 300 shows a simulation of the operation of wellbore system 200 and, more particularly, the downhole tools 100 made up in the production tubing 17. Graph 300 includes x-axis 301 that measures temperature (in ° F.), x-axis 302 that measures pressure (in psig), and y-axis 304 that measures bottom well depth (in feet). Graph 300 includes curves 306 through 324. Curve 306 represents the gas injection port curve. Curve 308 represents the valve curve. Curve 310 represents minimum pressure. Curve 312 represents pressure. Curve 314 represents unloading gradient. Curve 316 represents operating gas gradient. Curve 318 represents static reservoir gradient. Curve 320 represents temperature. Curve 322 represents unloading gradient from the gas injection port 108 of the uphole positioned downhole tool 100 to the surface. Curve 324 represents casing pressure gradient. Point 303 represents minimum pressure. Point 305 represents maximum pressure. Point 307 represents valve closing pressure. Point 309 represents valve opening pressure.

Generally, these curves show that the simulation of the gas injection system according to the present disclosure can revive or unload a dead well. For example, a well is dead at initial conditions due to high static reservoir fluid gradient in the wellbore. Through the operation of the gas injection system to flow a nitrogen gas into the annulus casing and to the production tubing through at least two gas injection ports with one as unloader and the second as an operating injector (for example, in an optimized approach), the hydrostatic pressure is reduced in the wellbore. This can lead to revival of the dead well and establishment of flow to the surface.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described may include more steps or fewer steps than those described. Further, the steps in such example operations, methods, or processes may be performed in different successions than that described or illustrated in the figures. Accordingly, other implementations are within the scope of the following claims.

What is claimed is:

1. A well system, comprising:

a production string that extends in a wellbore from a terranean surface toward a reservoir formation;

a downhole tool coupled within the production string, the downhole tool comprising:

a mandrel that comprises a top connection connected to the production string and a bottom connection connected to the production string to fluidly couple the mandrel to the production string, at least one gas injection port that fluidly couples the mandrel to an annulus of the wellbore, and a valve positioned to control a flow of a fluid from the annulus into the mandrel through the gas injection port; and a portable gas injection system configured to supply the fluid to the annulus to reduce a hydrostatic pressure of a wellbore fluid enclosed within at least one of the annulus or the production string; and a logging tool configured to move through the production string on a downhole conveyance, log the wellbore simultaneously with operation of the portable gas injection system to supply the fluid to the annulus to reduce the hydrostatic pressure of the wellbore fluid enclosed within the at least one of the annulus or the production string, and measure a composition of a mixture of the wellbore fluid and the fluid supplied to the annulus.

2. The well system of claim 1, wherein the fluid comprises nitrogen.

3. The well system of claim 2, wherein the portable gas injection system is configured to supply the nitrogen at 1500 psi.

4. The well system of claim 3, wherein the downhole tool is a first downhole tool, the system further comprising a second downhole tool coupled within the production string, the second downhole tool comprising:

a mandrel that comprises a top connection connected to the production string and a bottom connection connected to the production string to fluidly couple the mandrel to the production string;

at least one gas injection port that fluidly couples the mandrel to the annulus of the wellbore; and a valve positioned to control a flow of the fluid from the annulus into the mandrel through the gas injection port of the second downhole tool.

5. The well system of claim 1, wherein the top and bottom connections comprise threaded connections.

6. The well system of claim 1, wherein a length of the mandrel is less than 30 feet.

7. The well system of claim 1, wherein the downhole tool is a first downhole tool, the system further comprising a second downhole tool coupled within the production string, the second downhole tool comprising:

a mandrel that comprises a top connection connected to the production string and a bottom connection connected to the production string to fluidly couple the mandrel to the production string;

at least one gas injection port that fluidly couples the mandrel to the annulus of the wellbore; and a valve positioned to control a flow of the fluid from the annulus into the mandrel through the gas injection port of the second downhole tool.

8. The well system of claim 7, wherein the gas injection port of the second downhole tool is between 1500 and 2000 feet from the gas injection port of the first downhole tool.

9. The well system of claim 7, further comprising a packer positioned in the annulus downhole of the first and second downhole tools.

10. The well system of claim 1, wherein the fluid has at least one of a density or a viscosity less than the wellbore fluid.

11. A method for unloading a wellbore, comprising:

installing a portable gas injection system adjacent a production workstring that extends in a wellbore from a terranean surface to a reservoir formation, the production workstring comprising a downhole tool coupled within the production workstring, the downhole tool comprising:

a mandrel that comprises a top connection connected to the production string and a bottom connection connected to the production workstring to fluidly couple the mandrel to the production string, at least one gas injection port that fluidly couples the mandrel to an annulus of the wellbore, and a valve positioned to control a flow of a fluid from the annulus into the mandrel through the gas injection port;

operating the portable gas injection system to supply the fluid to the annulus to reduce a hydrostatic pressure of a wellbore fluid enclosed within at least one of the annulus or the production workstring;

logging the wellbore by moving a logging tool through the production workstring on a downhole conveyance simultaneously with operating the portable gas injection system to supply the fluid to the annulus to reduce the hydrostatic pressure of the wellbore fluid enclosed within the at least one of the annulus or the production workstring; and measuring, with the logging tool, a composition of mixture of the wellbore fluid and the fluid supplied to the annulus.

12. The method of claim 11, wherein the fluid comprises nitrogen.

13. The method of claim 12, wherein operating the portable gas injection system to supply the fluid to the annulus comprises operating the portable gas injection system to supply the nitrogen to the annulus at 1500 psi.

14. The method of claim 13, wherein the downhole tool is a first downhole tool, and the production workstring further comprises a second downhole tool comprising:

a mandrel that comprises a top connection connected to the production workstring and a bottom connection connected to the production workstring to fluidly couple the mandrel to the production workstring;

at least one gas injection port that fluidly couples the mandrel to the annulus of the wellbore; and a valve positioned to control a flow of the fluid from the annulus into the mandrel through the gas injection port of the second downhole tool, and the method further comprises:

operating the portable gas injection system to supply the fluid to the annulus and through the gas injection ports of the first and second downhole tools to reduce the hydrostatic pressure of the wellbore fluid enclosed within at least one of the annulus or the production workstring.

15. The method of claim 11, wherein the top and bottom connections comprise threaded connections.

16. The method of claim 11, wherein a length of the mandrel is less than 30 feet.

17. The method of claim 11, wherein the downhole tool is a first downhole tool, and the production workstring further comprises a second downhole tool comprising:

a mandrel that comprises a top connection connected to the production workstring and a bottom connection connected to the production workstring to fluidly couple the mandrel to the production workstring;

at least one gas injection port that fluidly couples the mandrel to the annulus of the wellbore; and a valve positioned to control a flow of the fluid from the annulus into the mandrel through the gas injection port of the second downhole tool.

18. The method of claim 17, further comprising:

operating the portable gas injection system to supply the fluid to the annulus and through the gas injection ports of the first and second downhole tools to reduce the hydrostatic pressure of the wellbore fluid enclosed within at least one of the annulus or the production workstring.

19. The method of claim 17, wherein the gas injection port of the second downhole tool is between 1500 and 2000 feet from the gas injection port of the first downhole tool.

20. The method of claim 17, wherein a packer is positioned in the annulus downhole of the first and second downhole tools.

21. The method of claim 11, wherein the fluid has at least one of a density or a viscosity less than the wellbore fluid.

* * * * *